US008484771B2

(12) United States Patent
Wilson et al.

(10) Patent No.: US 8,484,771 B2
(45) Date of Patent: Jul. 16, 2013

(54) TUB ENCLOSURE

(75) Inventors: David J. Wilson, New Baltimore, MI (US); Evan Carpenter Crawford, Farmington Hills, MI (US); Jeffrey A. DeBoer, Ann Arbor, MI (US)

(73) Assignee: Masco Bath Corporation, Moorestown, NJ (US)

( * ) Notice: Subject to any disclaimer, the term of this patent is extended or adjusted under 35 U.S.C. 154(b) by 25 days.

(21) Appl. No.: 13/366,454

(22) Filed: Feb. 6, 2012

(65) Prior Publication Data

US 2012/0124915 A1 May 24, 2012

Related U.S. Application Data

(63) Continuation of application No. 11/107,422, filed on Apr. 15, 2005, now Pat. No. 8,132,275.

(51) Int. Cl.
*A47K 3/32* (2006.01)

(52) U.S. Cl.
USPC ..... 4/600; 4/614

(58) Field of Classification Search
USPC ..... 4/538, 557, 584, 599, 600, 607, 612, 4/614, 559
See application file for complete search history.

(56) References Cited

U.S. PATENT DOCUMENTS

| | | | | |
|---|---|---|---|---|
| 1,990,871 | A * | 2/1935 | Klocke | 4/600 |
| 2,885,722 | A | 5/1959 | Halliday | |
| 3,385,462 | A | 5/1968 | Deldime et al. | |
| 3,574,869 | A | 4/1971 | Skyhawk | |
| 3,827,086 | A * | 8/1974 | Seymour et al. | 52/35 |
| 3,940,806 | A | 3/1976 | Mustee | |
| 3,996,705 | A | 12/1976 | Gutierrez | |
| 8,132,275 | B2 * | 3/2012 | Wilson et al. | 4/600 |

* cited by examiner

*Primary Examiner* — Huyen Le
(74) *Attorney, Agent, or Firm* — Carlson, Gaskey & Olds

(57) ABSTRACT

A tub enclosure includes a back wall and a first side wall attached to the back wall. The first side wall and the back wall establish an interior of the tub enclosure. An interior side of the first side wall extends past an interior side of the back wall to establish an offset between the first side wall and the back wall. A caulk joint extends along the offset between the back wall and the first side wall. The caulk joint is obscured from vision when viewed in a direction toward the interior.

15 Claims, 3 Drawing Sheets

TUB ENCLOSURE

CROSS-REFERENCE TO RELATED APPLICATION

This application is a continuation of U.S. patent application Ser. No. 11/107,422, filed Apr. 15, 2005 now U.S. Pat. No. 8,132,275.

BACKGROUND

This disclosure relates to a tub and shower enclosure.

Tub and shower enclosures generally include a wet wall, from which the shower head and faucet extend, a back wall, and a dry wall that opposes the wet wall. The three walls form a u-shaped enclosure. The fourth side is left open for entry and exit into the enclosure. Typically, a shower door or curtain is positioned along the fourth side. If the three walls were made of a single enclosure, it would be relatively large and heavy making shipping and installation awkward and difficult.

To make transportation and installation easier, the tub and shower enclosures commonly have been made of two or three separate pieces that are assembled together on site. The wet wall and half the back wall may form one piece and the dry wall and other half of the back wall may form a second piece. The pieces are manufactured separately and then assembled within the tub and shower enclosure. Caulk is used to seal the joint between the two pieces. The two piece system is still difficult to package and transport because of the awkward shape. For remodels and reconstructions situation it is difficult to get the pieces through the houses and into the tub area due to their size and shape.

SUMMARY

A tub enclosure includes a back wall and a first side wall attached to the back wall. The first side wall and the back wall establish an interior of the tub enclosure. An interior side of the first side wall extends past an interior side of the back wall to establish an offset between the first side wall and the back wall. A caulk joint extends along the offset between the back wall and the first side wall. The caulk joint is obscured from vision when viewed in a direction toward the interior.

A tub enclosure includes a back wall having a first end and a second end opposing the first end, a first side wall attached to the first end by a first hinge, and a second side wall attached to the second end by a second hinge. The first side wall, the back wall and the second side wall establish a U-shaped enclosure. The first hinge extends across an entire length of the back wall and the first side wall and the second hinge extends across an entire length of the back wall and the second side wall.

The various features and advantages of this disclosure will become apparent to those skilled in the art from the following detailed description. The drawings that accompany the detailed description can be briefly described as follows.

DETAILED DESCRIPTION OF THE PREFERRED EMBODIMENT

Figure 1:
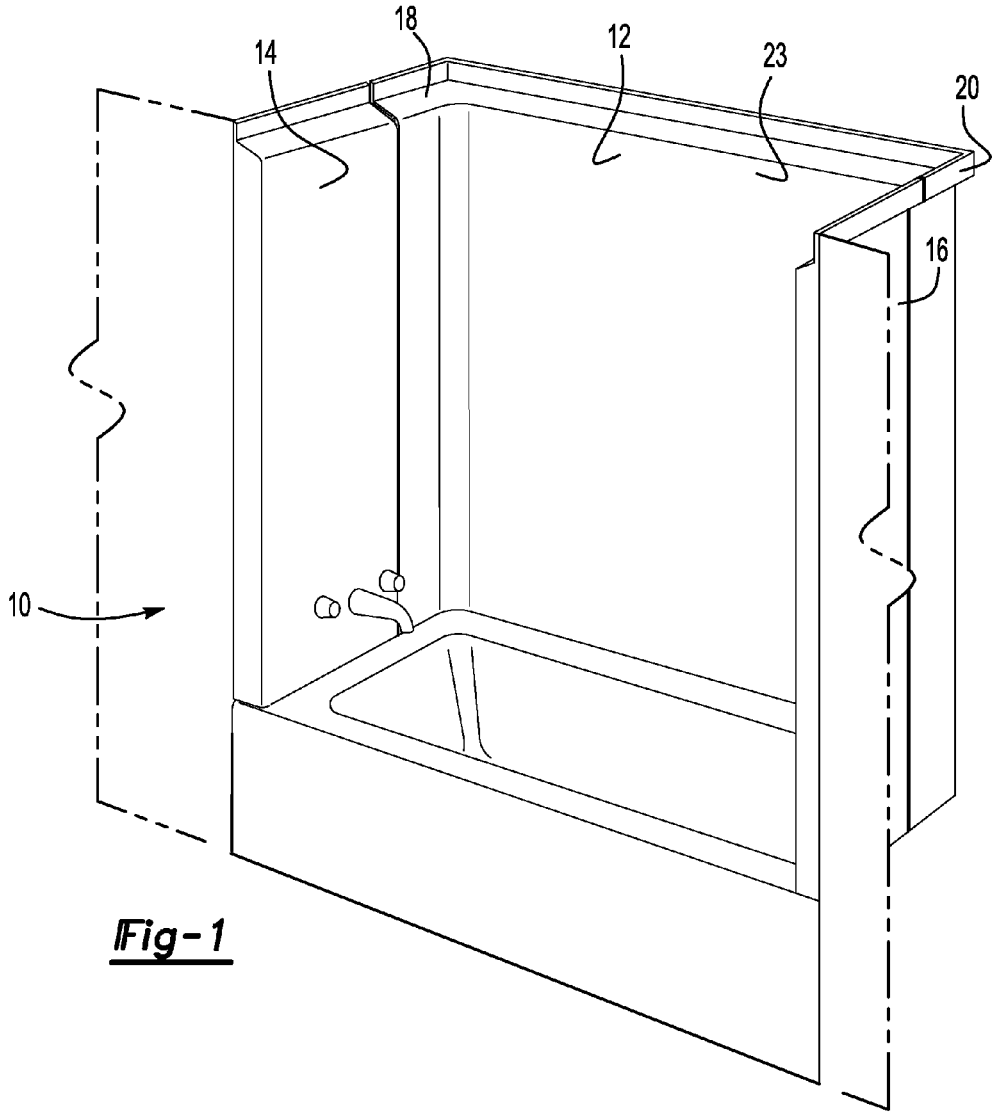
FIG. 1 is a perspective view of the tub and shower enclosure in the installation position.

FIG. 1 is a perspective view of an enclosure 10 for a tub or shower. The enclosure 10 has a back wall 12, a first side wall 14 and a second side wall 16. The first side wall 14 is connected to the back wall 12 at a first end 18. The second side wall 16 is connected to the back wall 12 at a second end 20 opposing the first end 18.

The first side wall 14 is a wet wall. That is, it receives the shower and tub faucet, showerhead, etc. The second side wall 16 is a dry wall, the wall opposing the wet wall in the enclosure 10. Together the three pieces form a U-shaped assembly. The open fourth side of the enclosure 10 is used for entering and exiting the enclosure 10. Additionally, the fourth side may accommodate a shower door, or curtain.

Figure 2:
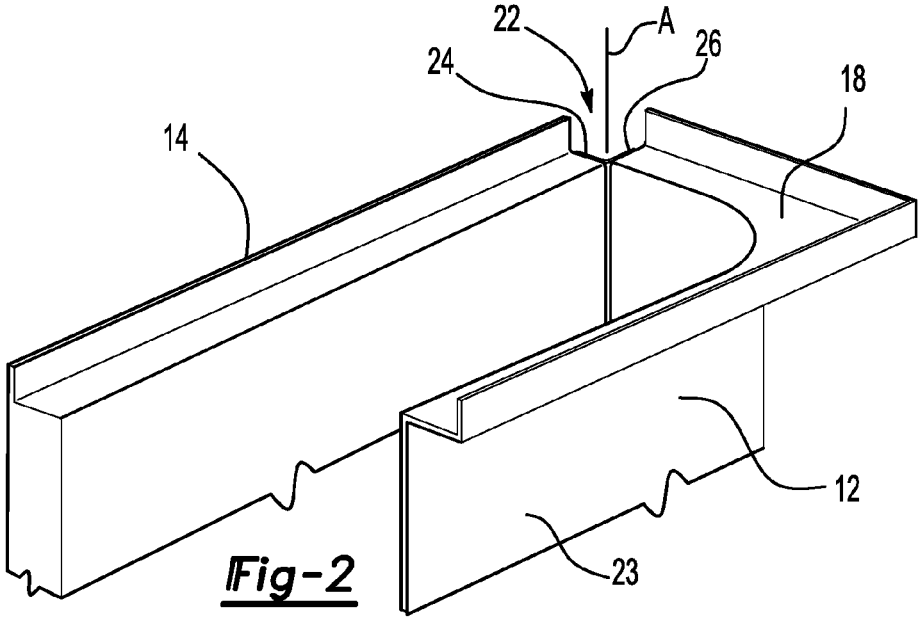
FIG. 2 is a perspective view showing the back wall and one of the side walls in the shipping position.

The first side wall 14 and second side wall 16 are connected to the back wall 12 in a similar manner. For simplicity, only the first side wall 14 and back wall 12 are discussed. Referring to FIG. 2, the first side wall 14 is connected to the back wall 12 by a hinge 22. The hinge 22 allows the first side wall 14 to rotate around an axis A defined by the hinge 22. The first side wall 14 rotates about the axis A relative to the back wall 12. The first side wall 14 is rotated into a position such that the first side wall 14 is generally parallel to a center wall portion 23 of the back wall 12. Although not shown the second side wall 16 would rotate about a similar hinge to also be generally parallel to the center wall portion 23 of the back wall 12. The enclosure 10 is shipped and moved when first side wall 14 and the second side wall 16 are positioned parallel to the center wall portion 23 of the back wall 12.

Figure 3:
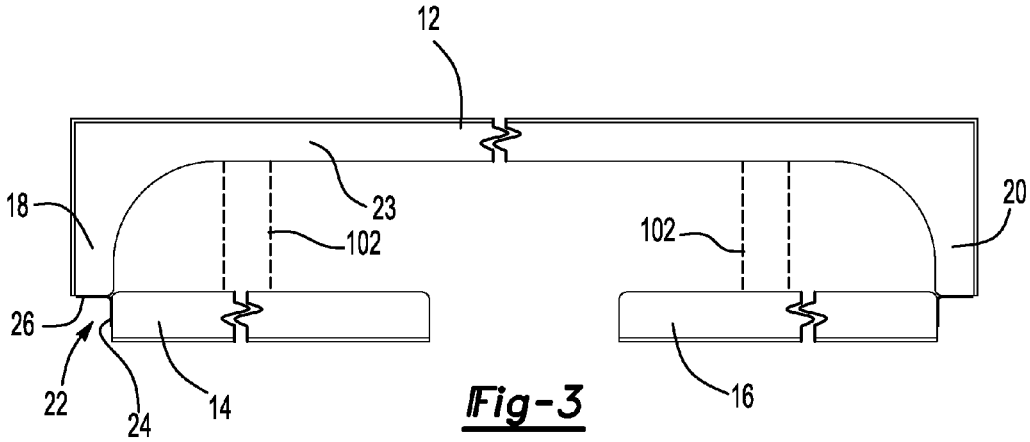
FIG. 3 is a end view of the back wall and one of the side walls in the shipping position.

FIG. 3 shows a perspective view of the first side wall 14 and back wall 12 in the shipping position. As can be appreciated, the three walls can be easily transported, moved to an installation position, and then unfolded for installation. Blocks 102 are shown schematically and may be sued to support the side walls during shipping.

A first portion 24 of the hinge 22 is connected to the first side wall 14. A second portion 26 of the hinge 22 is connected to the back wall 12. The hinge 22 may be connected to the first side wall 14 and back walk 12 by bonding, gluing, fasteners, or the like. One skilled in the art would be able to select an appropriate means of attachment.

Figure 4:
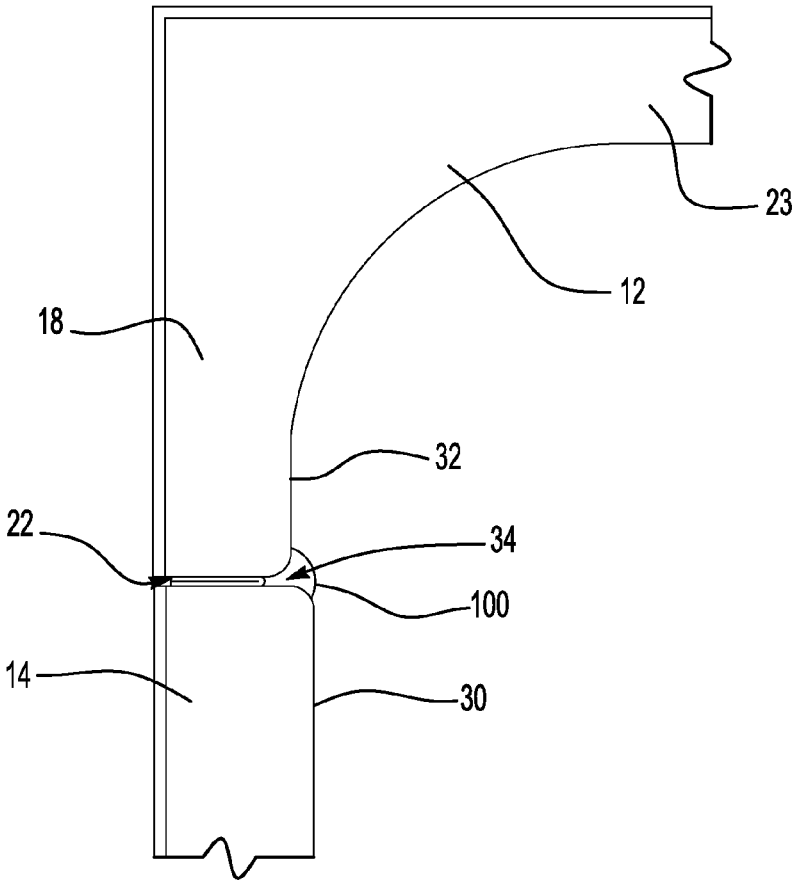
FIG. 4 is an end view of the back wall and one of the side walls in the installation position.

The hinge 22 is disclosed as a living hinge. That is, the hinge 22 is formed from one piece of material. The materially would generally be flexible enough to bend along a center hinge portion 28. The first portion 24 would be along one side of the center hinge portion 28 and the second portion 26 would be on the opposing side of the center hinge portion 28. When the hinge 22 is assembled to the first side wall 14 and the back wall 12 the center hinge portion 28 defines the axis A about which the first side wall 14 rotates. Of course, other type hinges may be utilized FIG. 4 shows an end view of the first side wall 14 and the back wall 12 in an installation position. The interior side 30 of the first side wall 14 extends past the interior side 32 of the back wall 12. The offset between the two walls creates an area 34 where caulk 100 can be applied to seal the joint while obscuring the joint from those looking into the interior of the enclosure 10. That is, the caulk 100 cannot be seen by those looking into the enclosure. In addition, the hinge 22 may run the entire height of the back wall 12 and first side wall 14 acting as a seal between the interior of the enclosure 10 and the sub wall (not shown) behind the enclosure 10.

Figure 5:
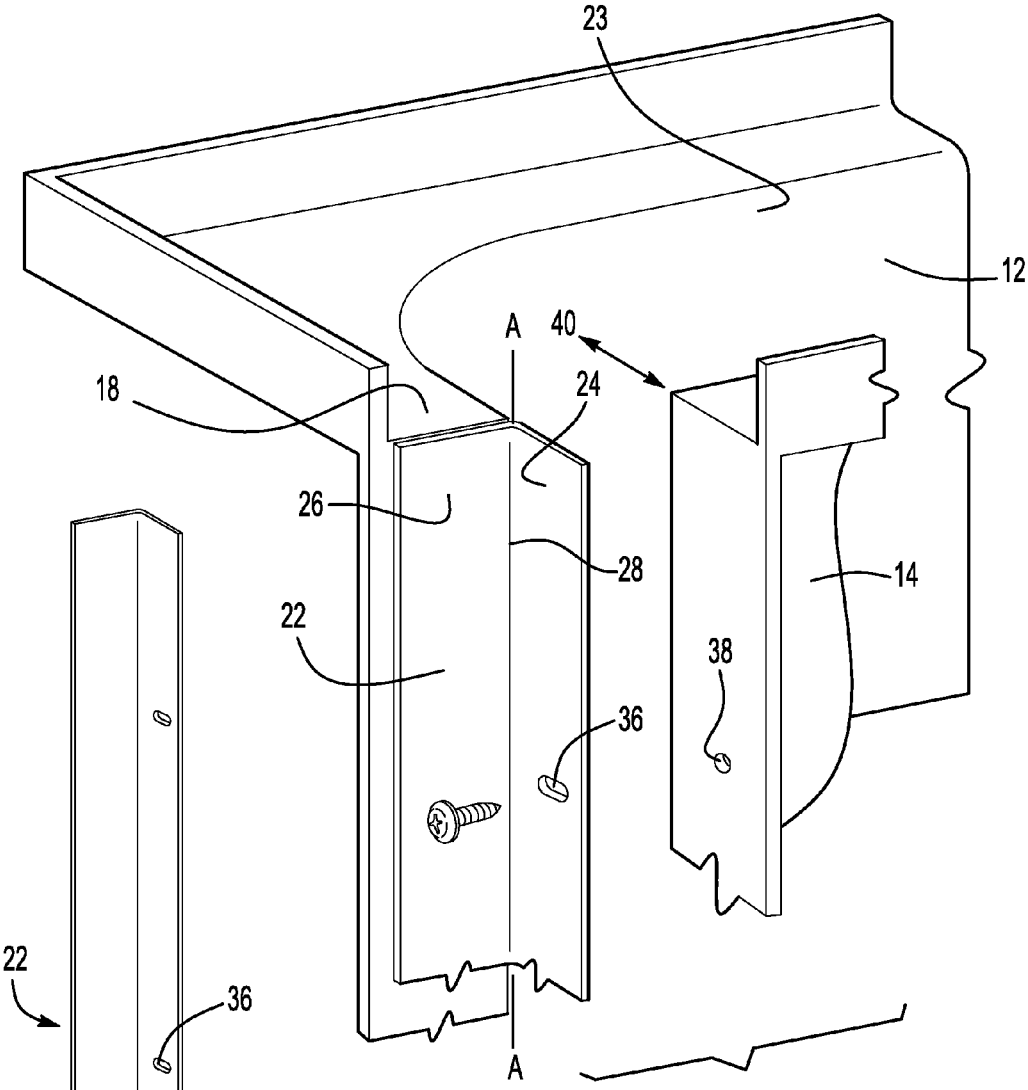
FIG. 5 is a perspective view of one embodiment of the hinge and side wall connection.
Figure 6:
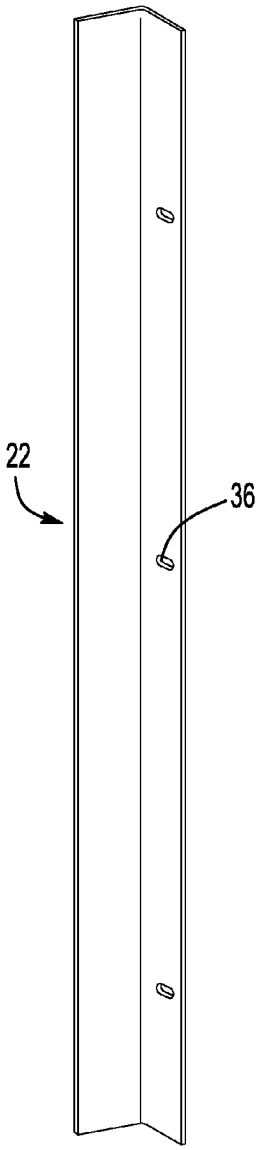
FIG. 6 is a perspective view of one embodiment of the living hinge.

FIG. 5 shows one embodiment of connecting the hinge 22 to the back wall 12 and first side wall 14. The first portion 24 may include a slot 36 and the first side wall 14 have a corresponding hole 38. A screw or other type of fastener may fit through slot 36 in the first portion 24 and into hole 38 in the first side wall 14 to attach the hinge 22 to the first side wall 14. The slot allows for the first side wall 14 to be move inward or outward as indicated by arrow 40 thus allowing alignment between the first side wall 14 and back wall 12 as the enclosure is being assembled. FIG. 6 shows the hinge 22. Several hinges 22 may used for each joint, or a single long hinge, relatively close to the height of the enclosure walls may be used.

Although a preferred embodiment of this disclosure has been disclosed, a worker of ordinary skill in this art would recognize that certain modifications could come within the scope of this disclosure. For that reason, the following claims should be studied to determine the true scope and content of this disclosure.

What is claimed is:

1. A tub enclosure, comprising:

a back wall;

a first side wall attached to said back wall, wherein said first side wall and said back wall establish an interior of the tub enclosure and an interior side of said first side wall extends past an interior side of said back wall to establish an offset between said first side wall and said back wall, wherein said offset occurs at a location where said back wall and said first side wall meet; and a caulk joint that extends along said offset between said back wall and said first side wall, wherein said caulk joint is obscured from vision when viewed in a direction toward said interior.

2. The tub enclosure as recited in claim 1, comprising a second side wall attached to said back wall, wherein said back wall, said first side wall and said second side wall establish a U-shaped enclosure.

3. The tub enclosure as recited in claim 2, wherein said offset extends in a direction from said first side wall toward said second side wall.

4. The tub enclosure as recited in claim 1, comprising a first hinge that attaches said first side wall to said back wall.

5. The tub enclosure as recited in claim 4, wherein said first hinge extends across an entire length of said back wall and said first side wall.

6. The tub enclosure as recited in claim 4, wherein a positioning of said first side wall is adjustable relative to said first hinge through at least one slot in said first hinge.

7. The tub enclosure as recited in claim 4, wherein a first portion of said first hinge is connected to said first side wall and a second portion of said first hinge is connected to said back wall.

8. The tub enclosure as recited in claim 7, wherein said first portion is rotatable about a center hinge portion that extends between said first portion and said second portion.

9. The tub enclosure as recited in claim 4, wherein said first hinge is a living hinge.

10. The tub enclosure as recited in claim 4, wherein said caulk joint extends at a location that is directly adjacent to said first hinge.

11. The tub enclosure as recited in claim 1, wherein said back wall includes a first portion having a first end and a second end opposing said first end, and second portions extending transversely from said first portion at each of said first end and said second end.

12. The tub enclosure as recited in claim 1, wherein an entire surface of said interior side of said first wall is offset from said interior side of said back wall.

13. A tub enclosure, comprising:

a back wall having a first portion including a first end and a second end opposing said first end, and second portions extending transversely from said first portion at each of said first end and said second end;

a first side wall attached to one of said second portions by a first hinge; and a second side wall attached to the other of said second portions by a second hinge, wherein said first side wall, said back wall and said second side wall establish a U-shaped enclosure, and wherein said first hinge extends across an entire length of said back wall and said first side wall and said second hinge extends across an entire length of said back wall and said second side wall.

14. The tub enclosure as recited in claim 13, wherein at least a portion of said back wall is generally parallel to said first side wall and said second side wall when positioned in a U-shape.

15. The tub enclosure as recited in claim 13, wherein interior sides of said first side wall and said second side wall are offset from an interior side of said second portions of said back wall in a direction toward the opposite side wall.

* * * * *